US008452550B2

(12) United States Patent
Jeong et al.

(10) Patent No.: US 8,452,550 B2
(45) Date of Patent: May 28, 2013

(54) METHOD OF ANALYZING LOAD-SETTLEMENT CHARACTERISTICS OF TOP-BASE FOUNDATION

(75) Inventors: Sang Seom Jeong, Seoul (KR); Jae Young Kim, Seoul (KR); Soo Kwan Kim, Seoul (KR)

(73) Assignee: Industry-Academy Cooperation Foundation, Yonsei University, Seoul (KR)

( * ) Notice: Subject to any disclaimer, the term of this patent is extended or adjusted under 35 U.S.C. 154(b) by 422 days.

(21) Appl. No.: 12/954,984

(22) Filed: Nov. 29, 2010

(65) Prior Publication Data

US 2011/0208445 A1 Aug. 25, 2011

(30) Foreign Application Priority Data

Feb. 24, 2010 (KR) ..... 10-2010-0016802

(51) Int. Cl.
*G01L 1/00* (2006.01)

(52) U.S. Cl.
USPC ..... 702/42

(58) Field of Classification Search
USPC ..... 702/42, 41, 43, 44, 182–185
See application file for complete search history.

(56) References Cited

U.S. PATENT DOCUMENTS

2009/0311050 A1* 12/2009 Martin, Sr. ..... 405/232

* cited by examiner

*Primary Examiner* — Edward Raymond
(74) *Attorney, Agent, or Firm* — Lexyoume IP Meister, PLLC.

(57) ABSTRACT

Disclosed herein is a method of analyzing load-settlement characteristics of a top-base foundation. The method includes the step of inputting properties of a material of a top base, a basic size of footing configuration, and a load of a structure, the step of inputting the kind of ground and a base ground thickness, the step of determining an influential depth and a load dispersion angle depending on the kind of ground, the step of inputting properties of the ground, the step of determining an immediate settlement amount of the ground, and the step of determining a total settlement amount. The method according to the present invention can precisely determine settlement taking into account footing configuration. Furthermore, the method calculates the settlement taking into account consolidation settlement when the ground is cohesive soil ground or top-cohesive-soil and bottom-sandy-soil ground. Thus, the settlement can be precisely determined.

14 Claims, 4 Drawing Sheets

METHOD OF ANALYZING LOAD-SETTLEMENT CHARACTERISTICS OF TOP-BASE FOUNDATION

CROSS-REFERENCE TO RELATED APPLICATION

This application claims priority to and the benefit of Korean Patent Application No. 10-2010-0016802 filed in the Korean Intellectual Property Office on Feb. 24, 2010, the entire contents of which are incorporated herein by reference.

BACKGROUND OF THE INVENTION

1. Field of the Invention

The present invention relates generally to methods of analyzing load-settlement characteristics of top-base foundations and, more particularly, to a method of analyzing load-settlement characteristics of a top-base foundation taking into account footing configuration and consolidation settlement depending on the kind of the ground.

2. Description of the Related Art

There is a lot of soft ground everywhere in the world. When construction for reinforcing such soft ground is conducted, an appropriate construction method for reinforcing soft ground is required to avoid problems of insufficient bearing capacity and settlement which may disturb the construction. However, over-design construction methods, such as deep foundation work, a soft-ground treatment method, etc., are not required.

Therefore, research into methods of reinforcing soft ground have been recently conducted regularly so that when a structure is constructed on soft ground which has insufficient bearing capacity, settlement can be prevented from being induced. A top-base method is a representative example of such soft ground reinforcement methods.

The top-base method is called a top-base foundation method, a concrete top-base foundation method, a concrete top-base type method, a concrete top type mat foundation method, a top-base mat foundation method, etc.

The top-base method is a soft-ground-surface treatment method for enhancing the bearing capacity of the ground and decreasing settlement when a structure is constructed on soft ground.

In the top-base method, top bases to which a load has been applied use location rods and connection rods which are arranged with the top bases to confine and compress the crushed stones they have been filled with and provide a reinforcing effect. This reinforces the ground foundation. The top-base foundation for ground surface treatment prevents lateral deformation and restrains settlement and differential settlement.

This top-base method is used, in place of a pile foundation method, to construct a medium or small structure the load of which is comparatively not large. The top-base foundation can enhance the bearing capacity of the ground and reduce settlement. Regardless of the conditions of a construction site or the use of large equipment, the construction time can be shortened, and over-design is prevented, so that efficient foundation work can be realized.

Furthermore, in the top-base method, a conical part having a top shape increases the area of contact and thus distributes the surface load, and embedment resistance of a pile part which embeds into the ground enhances the bearing capacity of the ground and reduces settlement of the ground.

As shown in FIG. 2, the top-base foundation includes top bases, location rods, connection rods and filling crushed stones. Each top base includes a conical part and a pile part. In an embodiment, the top surface of the top base has a diameter of 500 mm. The location rods function to guide the top bases at a correct installation position and serve as reinforcing bars. Mesh reinforcement is used as the location rods. The connection rods function to connect the top bases to each other in a lattice shape. Each connection rod has the same size as that of the location rod. The crushed stones, such as crushed gravels or the like, are used as a filler and charged into the space among the top bases. Moreover, before the location rods are arranged, sand and geotextile may be paved to separate the crushed stones from the soil and additionally increase the effect of improving the bearing capacity and restriction of settlement (refer to FIGS. 3 and 4).

When application of the pile foundation method causes over-design, it is advantageous to use the top-base method for the sake of economical efficiency. In addition, the top-base method can be conducted even in small construction sites. Furthermore, equipment used in the top-base method is comparatively simple. The top-base method is an environmentally friendly method, which generates neither noise nor vibration.

However, in the conventional top-base method, when settlement of the top-base foundation is determined, an influential depth to which settlement occurs is determined in a ratio of 1:1 to a footing configuration without taking into account consolidation settlement which may occur after the construction of the top-base foundation has been completed. Thus, the settlement determined by the conventional top-base method may differ greatly from the actual settlement of the construction site.

SUMMARY OF THE INVENTION

Accordingly, the present invention has been made keeping in mind the above problems occurring in the prior art, and a method of analyzing load-settlement characteristics of a top-base foundation has the following objects.

First, the amount of settlement is precisely determined taking into account the kind of the ground of a construction site.

Second, the amount of settlement is precisely determined taking into account a footing configuration.

Third, the amount of settlement is precisely determined taking into account the amount of consolidation settlement depending on the kind of the ground of the construction site.

The objects of the present invention are not limited to these, and other objects will be more clearly understood from the following detailed description by those skilled in the art.

In order to accomplish the above object, the present invention provides a method of analyzing load-settlement characteristics of a top-base foundation.

The method includes step S1 of inputting properties of a material of a top base, a basic size of a footing configuration, and a load of a structure.

The method includes step S2 of inputting a kind of a ground and a base ground thickness.

The method includes step S3 of determining an influential depth and a load dispersion angle depending on the kind of the ground that is input.

The method includes step S4 of inputting properties of the ground that is input.

The method includes step S5 of determining an immediate settlement of the ground that is input.

The method include step S6 of determining a total settlement.

At step S1, the basic size of the footing configuration may comprise a major side and a minor side of the footing configuration.

At step S3, the influential depth may be determined as 14 m when the kind of the ground that is input is cohesive soil ground or top-cohesive-soil and bottom-sandy-soil ground.

At step S3, the influential depth may be determined as 9 m when the kind of the ground that is input is sandy soil ground or top-sandy-soil and bottom-cohesive-soil ground.

At step S3, the loading dispersion angle may be determined as 65° when the kind of the ground that is input is cohesive soil ground.

At step S3, the loading dispersion angle may be determined as 60° when the kind of the ground that is input is top-cohesive-soil and bottom-sandy-soil ground.

At step S3, the loading dispersion angle may be determined as 55° when the kind of the ground that is input is top-sandy-soil and bottom-cohesive-soil ground.

At step S5, the influential depth of the ground may be divided into a plurality of layers by a predetermined interval, and a vertical stress ($\Delta\sigma_{zi}$) of each of the layers of the ground may be determined by applying properties of the corresponding layer to Equation 1, $$\Delta\sigma_{zi} = \frac{qB}{B + 2z\tan(\omega)} \quad \text{[Equation 1]}$$

where q denotes a basic uniformly distributed load (t/m$^2$), B is a minor side (m) of the footing configuration, ω denotes a load dispersion angle)(°), and z denotes an influential depth (m) from a surface of the ground.

At step S5, a vertical strain ($\epsilon_{zi}$) of each of the layers of the ground may be determined using Equation 2, $$\varepsilon_{zi} = \frac{1}{E}(1 - 2\nu K_0)\Delta_i \quad \text{[Equation 2]}$$

where E denotes a modulus of elasticity of the corresponding layer, v denotes a Poisson's ratio of the corresponding layer, and $K_0$ denotes a coefficient of earth pressure at rest.

At step S5, an immediate settlement ($S_{zi}$) of each of the layers of the ground may be determined using Equation 3, $$S_{zi} = \epsilon_{zi} \times H_i \quad \text{[Equation 3]}$$

where $H_i$ denotes a thickness of a layer i which is a corresponding layer.

At step S5, the immediate settlement ($S_i$) of the layers of the ground may be determined by summing up the immediate settlements ($S_{zi}$) of the respective layers.

When the kind of the ground is cohesive soil ground or top-cohesive-soil and bottom-sandy-soil ground, a consolidation settlement ($S_c$) may be determined using Equation 4, $$S_c = \frac{C_c}{1 + e_0} \times H \times \log\frac{P_0 + \Delta P}{P_0} \quad \text{[Equation 4]}$$

where C, denotes a compression index, $e_0$ denotes an initial void ratio, H denotes a thickness of a consolidation layer, $P_0$ denotes an average effective overburden pressure, and ΔP denotes an increment of an effective stress.

At step S6, the immediate settlement ($S_i$) of the layers may be determined as the total settlement when the kind of the ground that is input is sandy soil ground or top-sandy-soil and bottom-cohesive-soil ground.

At step S6, a sum of the immediate settlement ($S_i$) of the layers and the consolidation settlement ($S_c$) may be determined as the total settlement when the kind of the ground that is input is cohesive soil ground or top-cohesive-soil and bottom-sandy-soil ground.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a method of analyzing load-settlement characteristics of a top-base foundation according to an embodiment of the present invention will be described in detail with reference to the attached drawings.

Figure 1:
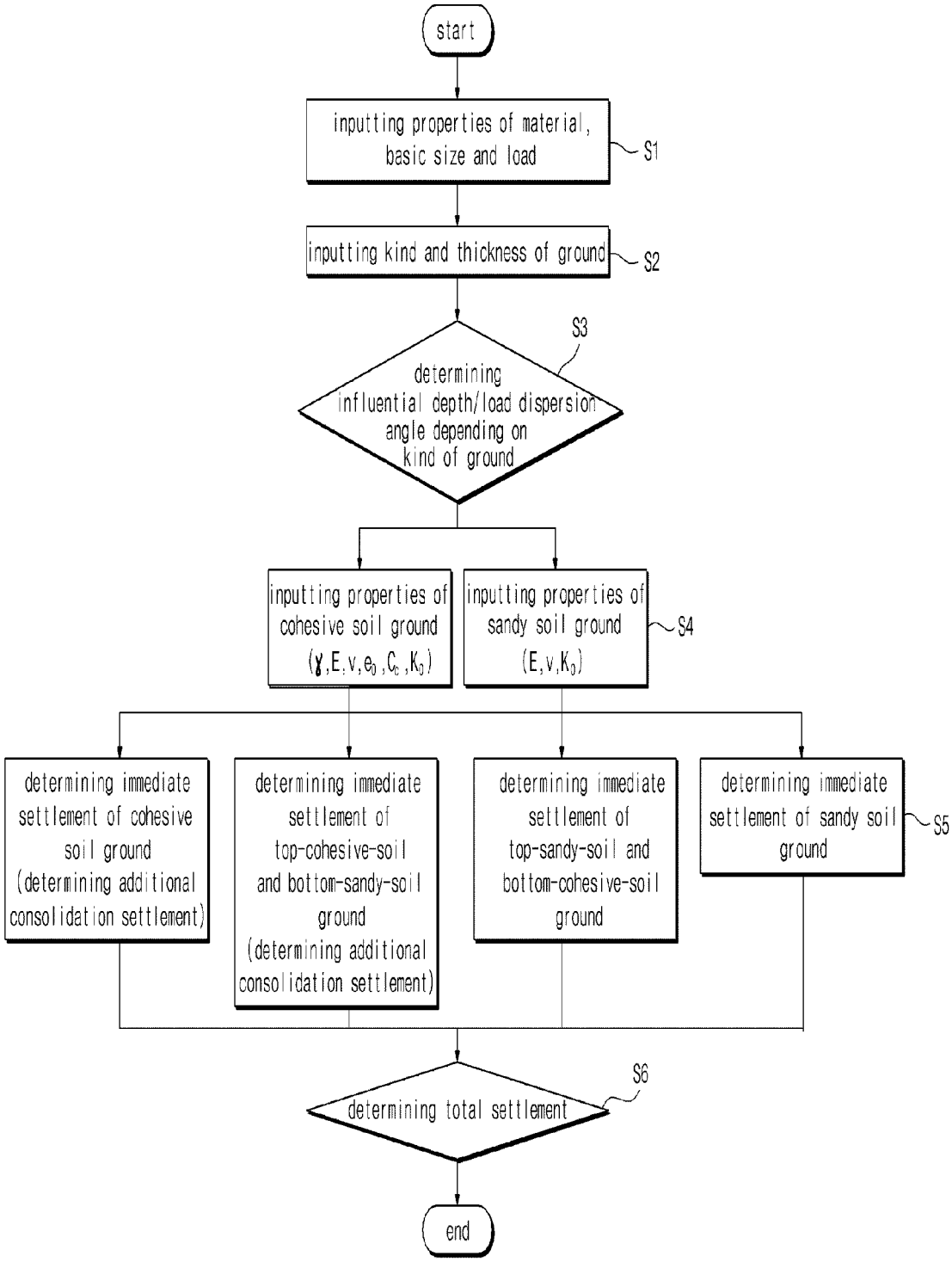
FIG. 1 is a flowchart of an algorithm of a method of analyzing load-settlement characteristics, according to the present invention.

FIG. 1 is a flowchart of an algorithm of the method of analyzing the load-settlement characteristics according to the present invention.

The method of analyzing the load-settlement characteristics of the top-base foundation according to the present invention includes step S1 of inputting properties of the material of a top base, a basic size of footing configuration, and a structure load.

At step S1, the basic size of the footing configuration includes a major side (L) and a minor side (B) of the footing configuration. The term "structure load" means the load of the structure to be constructed on the ground to which the top-base method is applied.

The method of analyzing the load-settlement characteristics of the top-base foundation further includes step S2 of inputting the kind of ground and the ground thickness (H). The term "ground thickness" means the thickness of the base ground.

The present invention is characterized in that the kind of ground is taken into account. In the present invention, the kinds of ground are classified as cohesive soil ground, top-cohesive-soil and bottom-sandy-soil ground, top-sandy-soil and bottom-cohesive-soil ground and sandy soil ground. When the settlement is determined according to the kind of the ground, whether the consolidation settlement is taken into account is determined. This will be described later herein.

The method of analyzing the load-settlement characteristics of the top-base foundation further includes step S3 of determining an influential depth (z) and a load dispersion angle (ω) depending on the kind of the ground that is input.

At step S3, the influential depth (Z) according to the kind of the ground is determined as follows. When the kind of the ground that is input is cohesive soil ground or top-cohesive-soil and bottom-sandy-soil ground, it is desirable that the influential depth (z) be set to 14 m. When the kind of the ground that is input is sandy soil ground or top-sandy-soil and bottom-cohesive-soil ground, it is desirable that the influential depth (z) be set to 9 m.

Furthermore, at step S3, the load dispersion angle (ω) according to the kind of the ground is determined as follows.

When the kind of the ground that is input is cohesive soil ground, it is preferable that the load dispersion angle (ω) be set to 65°. When the kind of the ground that is input is top-cohesive-soil and bottom-sandy-soil ground, it is preferable that the load dispersion angle (ω) be set to 60°. When the kind of ground that is input is sandy soil ground or top-sandy-soil and bottom-cohesive-soil ground, it is preferable that the load dispersion angle (ω) be set to 55°.

The method of analyzing the load-settlement characteristics of the top-base foundation further includes step S4 of inputting the properties of the ground that is input.

At step S4, required properties of the ground are input according to whether the kind of ground is cohesive soil ground or sandy soil ground.

The method of analyzing the load-settlement characteristics of the top-base foundation further includes step S5 of determining immediate settlement of the ground that is input.

At step S5 of determining the immediate settlement of the ground, information about the kind of the ground that corresponds to the influential depth (z) is obtained by ground investigation.

The determining of the immediate settlement of the ground that corresponds to the influential depth (z) includes dividing the influential depth (z) of the ground into a plurality of layers by a predetermined interval, and determining immediate settlement of each layer, and then determining immediate settlement of the entire layer by summing up the immediate settlements of the respective layers.

The interval, that is, the thickness of each layer, is not limited to a special numerical value but it may be set to various numerical values. For example, it is desirable that the interval be the length of the top base.

Figure 2:
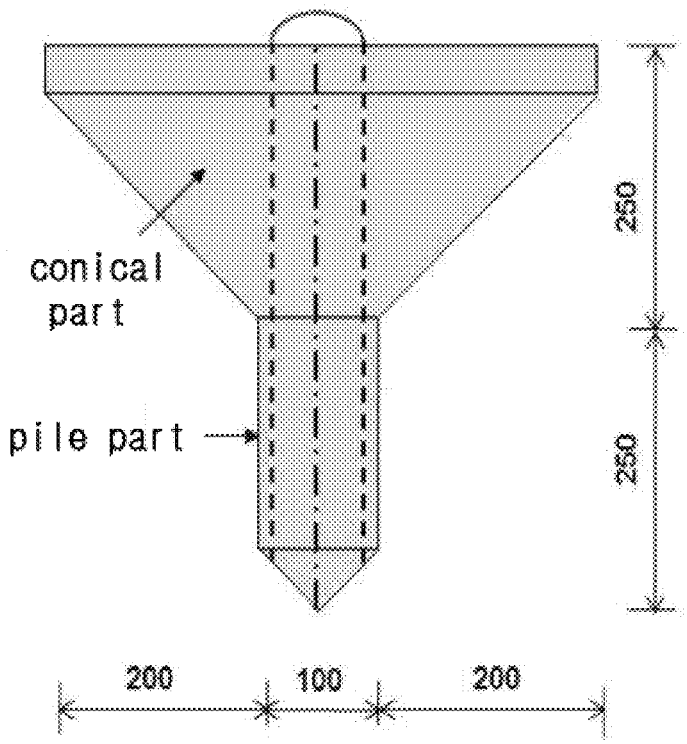
FIG. 2 is a view showing a top base according to the present invention.
Figure 3:
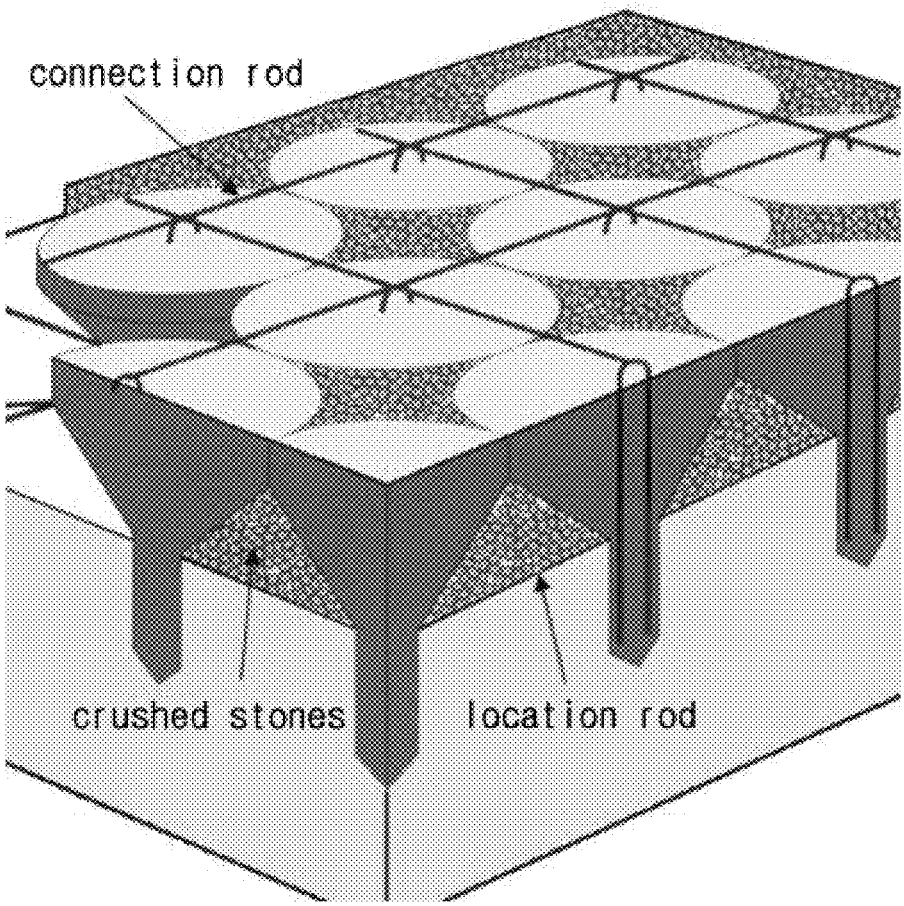
FIG. 3 is a sectional perspective view of a top-base foundation according to the present invention.
Figure 4:
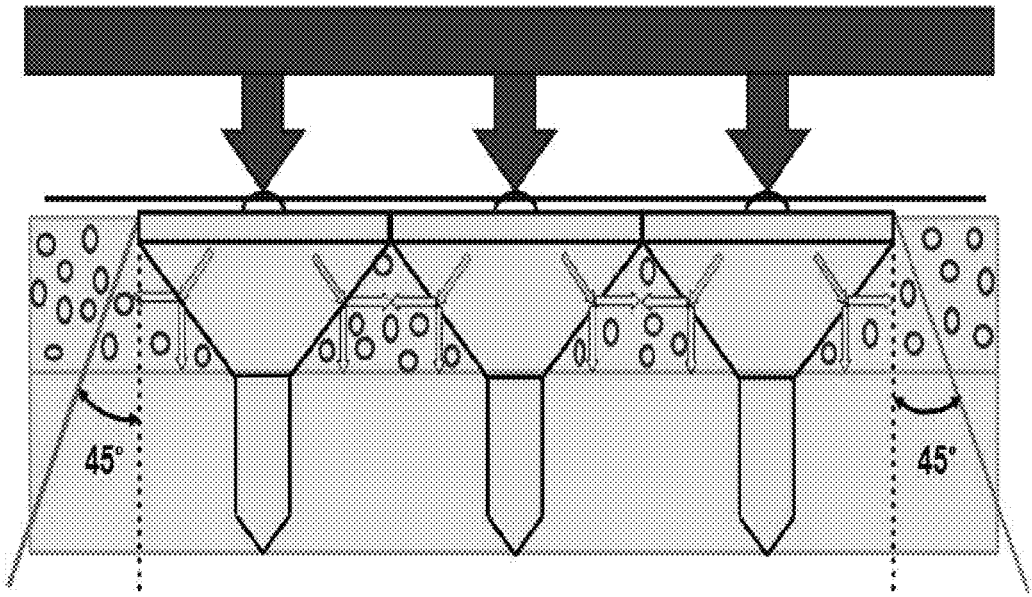
FIG. 4 is a view illustrating the principle of a top-base method according to the present invention.

In an embodiment of the top base, as shown in FIG. 2, the length of the top base is 0.5 m. Thus, the present invention will be explained below as if the thickness of each layer were 0.5 m.

For example, if the influential depth (z) is 9 m, when the thickness of each layer is set to 0.5 m, the ground is divided into eighteen layers. Whether each of the eighteen layers is cohesive soil ground or sandy soil ground is determined by investigating the ground. If cohesive soil and sandy soil are present together in a single layer, in the present invention, it is regarded as cohesive soil ground which is softer than sandy soil ground.

Determining the immediate settlement of each layer includes obtaining a vertical stress of the layer, and obtaining a vertical strain of the layer, and then determining the immediate settlement of the layer using the obtained vertical stress and vertical strain.

The vertical stress ($\Delta\sigma_{zi}$) of each layer of the ground can be calculated by the following Equation 1.

$$\Delta\sigma_{zi} = \frac{qB}{B + 2z\tan(\omega)} \quad \text{[Equation 1]}$$

Here, the character q denotes a coefficient related to a basic uniformly distributed load (t/m$^2$) applied to the top base. The character B is related to a minor side (m) of the footing configuration, that is, of the top-base width. The character z denotes an influential depth, that is, a vertical depth from the surface of the ground. The character ω denotes a load dispersion angle)(°), that is, an angle at which a vertical load from the surface of the ground is uniformly distributed to beneath the ground.

According to Equation 1, the vertical stress ($\Delta\sigma_{zi}$) of each layer of the ground is obtained by dividing a value of qB which is a load per a unit area by a value of B+2z tan(ω) which is a horizontal side at the corresponding depth. In other words, the vertical stress B+2z tan(ω) means an average vertical stress at the center of each layer.

The vertical strain ($\epsilon_{zi}$) of each layer of the ground can be calculated by the following Equation 2.

$$\varepsilon_{zi} = \frac{1}{E}(1 - 2\nu K_0)\Delta_i \quad \text{[Equation 2]}$$

Here, the character E denotes a modulus of elasticity of each layer, v denotes a Poisson's ratio of the corresponding layer, and $K_0$ denotes a coefficient of earth pressure at rest.

Equation 2 indicates a strain rate with respect to the vertical direction at each layer. The result of Equation 2 is obtained from the modulus of elasticity of each layer and the average vertical stress of each layer that is determined by Equation 1 according to Hook's law.

The immediate settlement ($S_{zi}$) of each layer of the ground can be calculated by the following Equation 3.

$$S_{zi} = \epsilon_{zi} \times H \quad \text{[Equation 3]}$$

Here, the character $H_i$ denotes a thickness of a layer i, that is, of each layer.

Equation 3 indicates the settlement of each of the layers into which the ground is divided by an interval corresponding to the length of the top base.

The immediate settlement of the ground, in other words, the total immediate settlement ($S_i$) of the all the divided layers, can be obtained by summing up the immediate settlements ($S_{zi}$) of the respective layers.

Meanwhile, the method of analyzing the load-settlement characteristics of the top-base foundation according to the present invention further includes a step of determining an additional consolidation settlement when the ground is cohesive soil ground or top-cohesive-soil and bottom-sandy-soil ground.

The consolidation settlement ($S_c$) can be calculated by the following Equation 4.

$$S_c = \frac{C_c}{1 + e_0} \times H \times \log\frac{P_0 + \Delta P}{P_0} \quad \text{[Equation 4]}$$

Here, ($S_c$) denotes consolidation settlement. $C_c$ denotes a compression index and is a gradient of a normal consolidation portion of a consolidation curve. $e_0$ denotes an initial void ratio. H denotes a thickness of a consolidation layer in which consolidation occurs. In the present invention, the character H means a thickness of a cohesive soil layer. $P_0$ denotes an average effective overburden pressure, that is, an effective stress from the surface to the intermediate portion of a clay layer in which consolidation occurs. $P_0$ is calculated by the γ of cohesive soil ground and a depth of the base ground. ΔP denotes an increment of an effective stress from the surface to the intermediate portion of the clay layer.

The method of analyzing the load-settlement characteristics of the top-base foundation according to the present invention further includes step S6 of determining total settlement.

At step S6, when the kind of the ground is sandy soil ground or top-sandy-soil and bottom-cohesive-soil ground, the total settlement is the same as the immediate settlement ($S_i$) of the all divided layers, because consolidation settlement is not taken into account in this case.

At step S6, when the kind of the ground is cohesive soil ground or top-cohesive-soil and bottom-sandy-soil ground, the total settlement is the sum of the immediate settlement ($S_i$) and the consolidation settlement ($S_c$) of the all divided layers, because consolidation settlement must be taken into account in this case.

As described above, a method of analyzing load-settlement characteristics of a top-base foundation according to the present invention can precisely determine settlement taking into account footing configuration. Furthermore, the method according to the present invention calculates the settlement taking into account consolidation settlement when the ground is cohesive soil ground or top-cohesive-soil and bottom-sandy-soil ground. Thus, the amount of settlement can be precisely determined.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A method of analyzing load-settlement characteristics of a top-base foundation, comprising:

inputting properties of a material of a top base, a basic size of a footing configuration, and a load of a structure;

inputting a kind of a ground and a base ground thickness;

determining an influential depth and a load dispersion angle depending on the kind of the ground that is input;

inputting properties of the ground that is input;

determining an immediate settlement of the ground that is input; and determining a total settlement.

2. The method as set forth in claim 1, wherein the inputting of the basic size of the footing configuration comprises inputting a major side and a minor side of the footing configuration.

3. The method as set forth in claim 1, wherein the determining of the influential depth comprises determining the influential depth as 14 m when the kind of the ground that is input is cohesive soil ground or top-cohesive-soil and bottom-sandy-soil ground.

4. The method as set forth in claim 1, wherein the determining of the influential depth comprises determining the influential depth as 9 m when the kind of the ground that is input is sandy soil ground or top-sandy-soil and bottom-cohesive-soil ground.

5. The method as set forth in claim 1, wherein the determining of the load dispersion angle comprises determining the loading dispersion angle as 65° when the kind of the ground that is input is cohesive soil ground.

6. The method as set forth in claim 1, wherein the determining of the load dispersion angle comprises determining the loading dispersion angle as 60° when the kind of the ground that is input is top-cohesive-soil and bottom-sandy-soil ground.

7. The method as set forth in claim 1, wherein the determining of the load dispersion angle comprises determining the loading dispersion angle as 55° when the kind of the ground that is input is top-sandy-soil and bottom-cohesive-soil ground.

8. The method as set forth in claim 1, wherein the determining of the immediate settlement comprises:

dividing the influential depth of the ground into a plurality of layers by a predetermined interval; and determining a vertical stress ($\Delta\sigma_{zi}$) of each of the layers of the ground by applying properties of the corresponding layer to Equation 1, $$\Delta\sigma_{zi} = \frac{qB}{B + 2z\tan(\omega)} \quad \text{[Equation 1]}$$

(where q denotes a basic uniformly distributed load (t/m$^2$), B is a minor side (m) of the footing configuration, ω denotes a load dispersion angle)(°), and z denotes an influential depth (m) from a surface of the ground).

9. The method as set forth in claim 8, wherein the determining of the immediate settlement comprises:

determining a vertical strain ($\epsilon_{zi}$) of each of the layers of the ground using Equation 2, $$\varepsilon_{zi} = \frac{1}{E}(1 - 2vK_0)\Delta_i \quad \text{[Equation 2]}$$

(where E denotes a modulus of elasticity of the corresponding layer, v denotes a Poisson's ratio of the corresponding layer, and $K_0$ denotes a coefficient of earth pressure at rest).

10. The method as set forth in claim 9, wherein the determining of the immediate settlement comprises:

determining an immediate settlement ($S_{zi}$) of each of the layers of the ground using Equation 3, $$S_{zi} = \epsilon_{zi} \times H_i \quad \text{[Equation 3]}$$

(where $H_i$ denotes a thickness of a layer i which is a corresponding layer).

11. The method as set forth in claim 10, wherein the determining of the immediate settlement comprises:

determining the immediate settlement ($S_i$) of the layers of the ground by summing up the immediate settlements ($S_{zi}$) of the respective layers.

12. The method as set forth in claim 1, further comprising:

determining a consolidation settlement ($S_c$) using Equation 4, when the kind of the ground is cohesive soil ground or top-cohesive-soil and bottom-sandy-soil ground, $$S_c = \frac{C_c}{1 + e_0} \times H \times \log\frac{P_0 + \Delta P}{P_0} \quad \text{[Equation 4]}$$

(where $C_c$ denotes a compression index, $e_0$ denotes an initial void ratio, H denotes a thickness of a consolidation layer, $P_0$ denotes an average effective overburden pressure, and ΔP denotes an increment of an effective stress).

13. The method as set forth in claim 11, wherein the determining of the total settlement comprises determining the immediate settlement ($S_i$) of the layers as the total settlement when the kind of the ground that is input is sandy soil ground or top-sandy-soil and bottom-cohesive-soil ground.

14. The method as set forth in claim 12, wherein the determining of the total settlement comprises determining a sum of the immediate settlement ($S_i$) of the layers and the consolidation settlement ($S_c$) as the total settlement when the kind of the ground that is input is cohesive soil ground or top-cohesive-soil and bottom-sandy-soil ground.

* * * * *